US005865180A

United States Patent [19]

Sigfrid

[11] Patent Number: 5,865,180

[45] Date of Patent: Feb. 2, 1999

[54] ERGONOMIC PAD AND PAD HOLDER

[76] Inventor: Tracy D. Sigfrid, P.O. Box 48562, Minneapolis, Minn. 55433

[21] Appl. No.: 861,671

[22] Filed: May 22, 1997

Related U.S. Application Data

[60] Provisional application No. 60/018,303 May 24, 1996.

[51] Int. Cl.[6] ..... A61G 15/00

[52] U.S. Cl. ..... 128/845; 128/878; 135/71

[58] Field of Search ..... 128/845, 846, 128/877, 878, 879; 135/71, 72, 73, 68

[56] References Cited

U.S. PATENT DOCUMENTS 5,486,206 1/1996 Avery ..... 607/104

*Primary Examiner*—Michael A. Brown
*Attorney, Agent, or Firm*—Angenehm Law Firm, Ltd.; N. Paul Friedericks, III

[57] ABSTRACT

In one embodiment, a shoulder, arm or hand cushion includes a plush fabric piece having dual overlapping opposing pockets formed therein for a resilient pad such as a viscoelastic gel pad. The dual overlapping pockets define a tortuous path for escape of the viscoelastic gel pad to minimize loss of the viscoelastic gel pad. A neck having a size less than the size of the pockets combined or less than the size of the viscoelastic gel pad further minimizes loss of the viscoelastic gel pad. Yet the viscoelastic gel pad is easily removable by turning the plush fabric piece inside out to permit the plush fabric piece to be washed. The cushion may be used on the shoulder portion of a crutch. In another embodiment, the shoulder, arm or hand cushion is formed from a viscoelastic molded material having a base inner layer of a molded material of first relatively firm degree of hardness and an outer layer of a viscoelastic molded material of a second relatively soft degree of hardness where the outer layer conforms to the shape of a portion of a shoulder, arm or hand. Preferably, the base inner layer is also viscoelastic.

21 Claims, 9 Drawing Sheets

10
15
TURN
RIGHT
SIDE OUT
38
13
40
VISCOELASTIC
GEL PACK
15
DUAL OVERLAPPING
POCKET COVERING
12
42
14
66
16
30
20
TURN
OVER
20
DUAL OVERLAPPING
POCKET COVERING
22
42
100a
18
28
38
VISCOELASTIC
GEL PACK
40
26
32
34
36

10
42
44
58a
58a
62
48
58b
52
58b
14
44
52
54
59b
15
59b
50
46
62
59a
59a
42

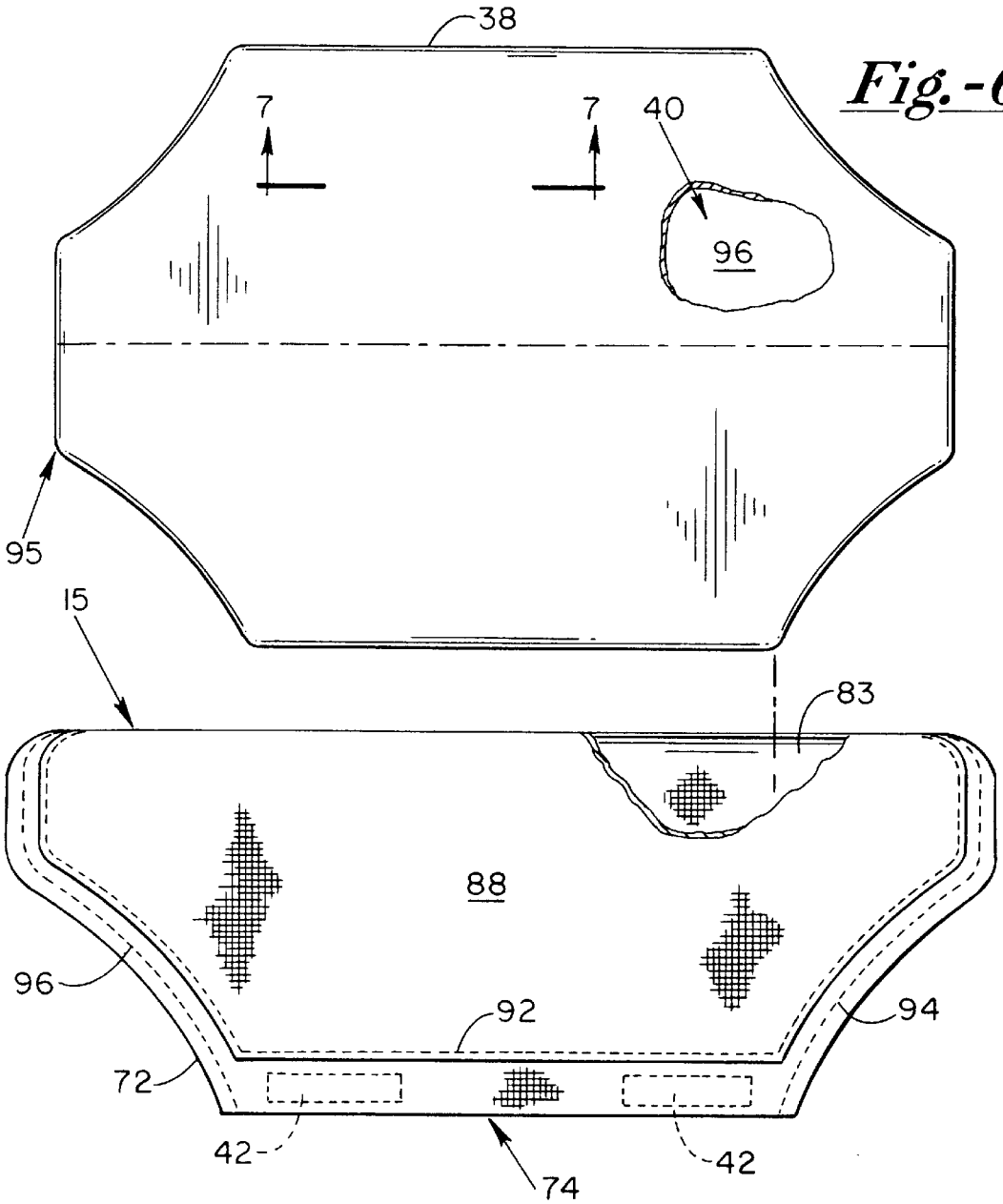
Fig.-6
Fig.-7
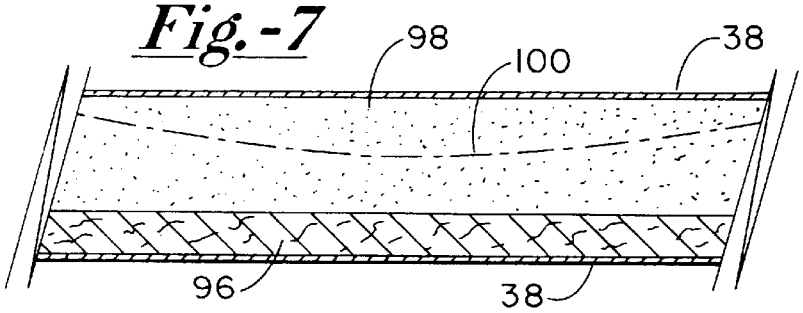

ERGONOMIC PAD AND PAD HOLDER

This application claims the benefit under Title 35, United States Code § 119(e) of my U.S. provisional application No. 60/018,303 filed May 24,1996 and entitled Crutch Assist Shoulder Pad And Grip Pad. Such provisional application No. 60/018,303 is hereby incorporated by reference in its entirety into this application.

BACKGROUND OF THE INVENTION

The present invention relates generally to cushions for the shoulder, arm or hand and, more particularly, to such cushions having viscoelastic gel.

For the newly injured, a crutch is most probably a new and only temporary device and this patient may tend to ignore advice on the recommended manner of use of the crutch. The patient may tend to place their fill body weight on the shoulder (or exterior muscles of the underarm) piece of the crutch, instead of stiffening the elbow such that the shoulder piece is spaced two or so inches below the armpit. The incorrect manner of use of the crutch may result in serious damage to the brachial plexus and/or pain associated with extended use of the conventional crutch.

A less serious problem with crutch use is that underarms sweat. Such is especially the case for one using a crutch. Accordingly, it is preferably that a covering for the underarm or shoulder portion of a crutch be washable.

SUMMARY OF THE INVENTION

A general object of the present invention is to provide a unique cushion for an interaction between the shoulder, arm or hand and a structure such as a crutch.

Another object of the present invention is to provide in such a cushion a unique double layered cushion of moldable material A base inner layer of moldable material is relatively firm and an outer layer of the visco elastic moldable material is relatively soft so as to conform to a portion of the shoulder, arm or hand.

Another object of the present invention is to provide in such a cushion a unique double layered cushion of moldable material where both the base inner layer and outer layer are viscoelastic.

Another object of the present invention is to provide in such a cushion a unique fabric piece with a pocket formed therein. Specifically, the fabric piece includes an interior for receiving a portion of the structure. The pocket is formed in the interior and holds a resilient pad for distributing pressure exerted by the structure.

Another object of the present invention is to provide in such a cushion a pair of pockets which open toward each other and which preferably overlap so as to more securely contain the resilient pad therein.

Another object of the present invention is to provide in such a cushion a neck having a width less than the combined width of the pockets or less than the width of the resilient pad such that, even if the resilient pad falls from the overlapping pockets, such neck retains the resilient pad in the cushion unless the neck is stretched.

Another object of the present invention is to provide in such a cushion a tortuous path for placing and removing the resilient pad in the pocket. Further, the cushion is easily turned inside out for providing a less tortuous path for placing and removing the resilient pad in the pocket.

Another object of the present invention is to provide in such a cushion a resilient pad which is shaped to generally reflect the shape of the pocket such that longitudinal and lateral movement of the resilient pad relative to the pocket is minimized.

Another object of the present invention is to provide for such resilient pad a viscoelastic gel filled envelope in the pocket.

Another object of the present invention is to provide in such a cushion a plush, stretchable and washable fabric for the fabric piece.

Advantages of the present invention include the following:

- pressure point pain and irritation of portions of the shoulder, arm and hand is alleviated;
- stresses that may lead to carpel tunnel syndrome are decreased;
- the fabric and gel filled envelope cushion and molded gel cushion are durable;
- the plush fabric piece may be formed of an attractive fabric;
- the fabric and gel filled envelope cushion and molded gel cushion are simple and easy to manufacture;
- the fabric piece is washable, thereby providing a hygienic device; and
- the fabric and gel filled envelope cushion and molded gel cushion may be antibacterial, anti-static, hypoallergenic, and odor resistant.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where:

FIG. 6 shows an exploded view of the shoulder gel cushion of FIG. 5 receiving a viscoelastic gel pack, and a portion of the figure is broken away to show the base or outer covering upon which the underarm of a shoulder directly rests.

FIG. 7 shows a partial section view of the viscoelastic gel pack of FIG. 6 and indicates how the gel preferably includes dual layers of relatively hard and soft viscoelastic gel.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

DESCRIPTION

Figure 1:
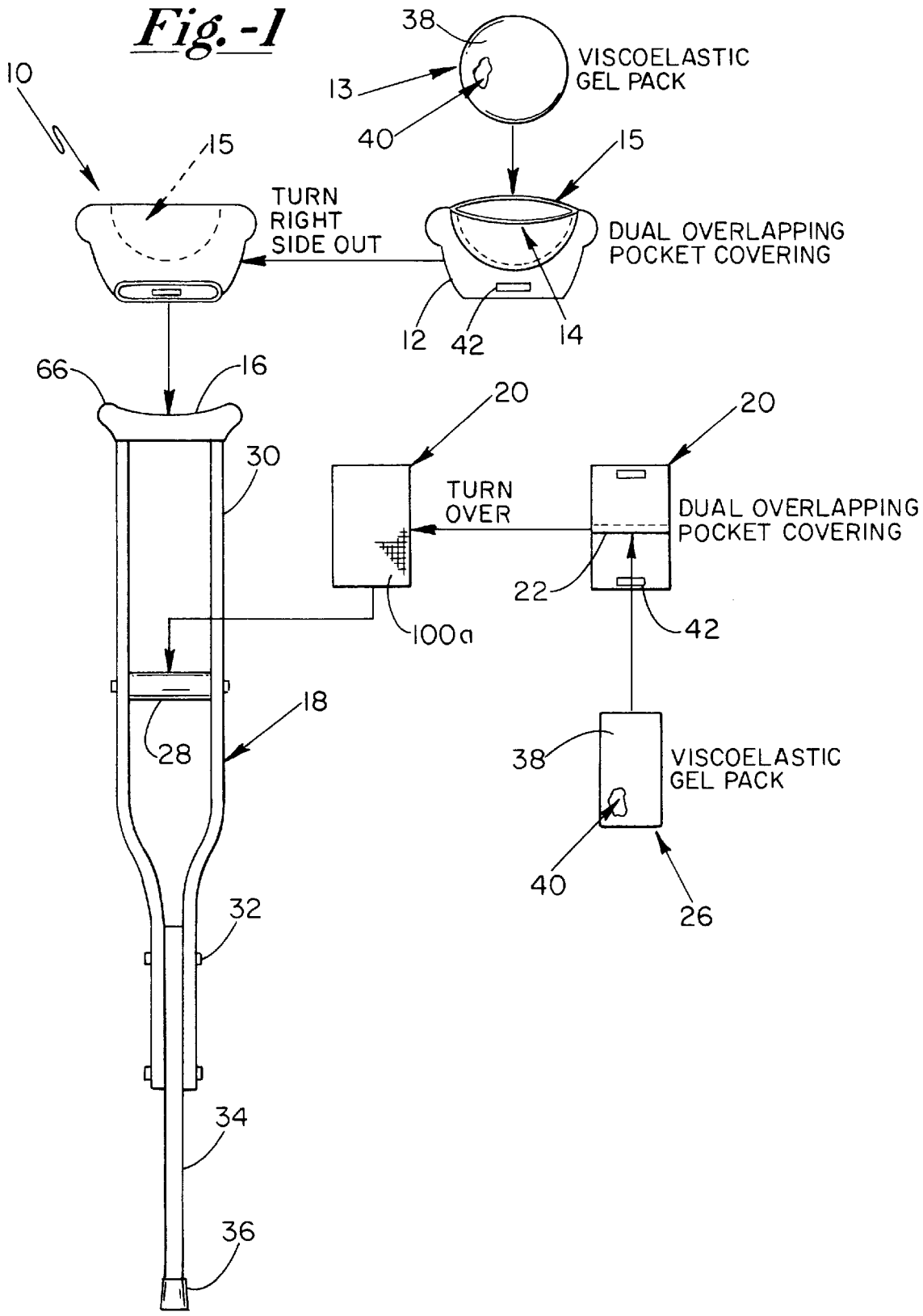
FIG. 1 shows an exploded view of one embodiment of the gel cushion of the present invention, and shows one gel cushion for the shoulder portion of a crutch and another gel cushion for the hand grip of a crutch.

As shown in FIG. 1, the one embodiment of the shoulder gel cushion of the present invention is indicated by reference numeral 10, when turned right-side out. Reference numeral 12 indicates such gel cushion turned inside out so as to readily accept a viscoelastic disk shaped gel pack 13 in dual overlapping pockets 14 and 15. When turned right-side out, the shoulder gel cushion 10 is placed on the shoulder portion 16 of a crutch 18. FIG. 1 further shows a hand grip gel cushion 20 having dual overlapping pockets 22, 24 for accepting a hand grip viscoelastic bar shaped gel pack 26. The hand grip gel cushion 20 is folded over and wrapped about a hand grip 28 of the crutch 18.

Crutch 18 is the preferred type of crutch for use with the present invention. The shoulder portion 16 is formed in the shape of an arc and may or may not have cushion qualities. Shoulder portion 16 is supported by a pair of columns 30, which run towards each other and are fixed relative to each other by pin connectors 32. Sandwiched between the columns 30 is a crutch leg 34 having through holes formed therein for receiving the pin connectors 32 for adjusting the height of the crutch 18. Crutch leg 34 includes a nonslip cushioned foot 36. It should be noted that aluminum crutches are different in that such crutches have length adjustors on the columns 30.

FIG. 1 further indicates that each of the viscoelastic gel packs 13 and 26 includes a shell 38 which envelopes a viscoelastic gel or viscoelastic gel layer arrangement 40 therein. Shell 38 is preferably formed from an elastomeric, moisture resistant material such as a heat cured rubber. Heat cured silicone rubber is preferred. Such shell 38 is farther preferably heat sealed so as to isolate the viscoelastic gel therein.

FIG. 1 further shows closures for each of the gel cushions 10 and 20. Such closures are indicated by reference numeral 42 and preferably are hook and loop fasteners such as Velcro®.

Figure 2:
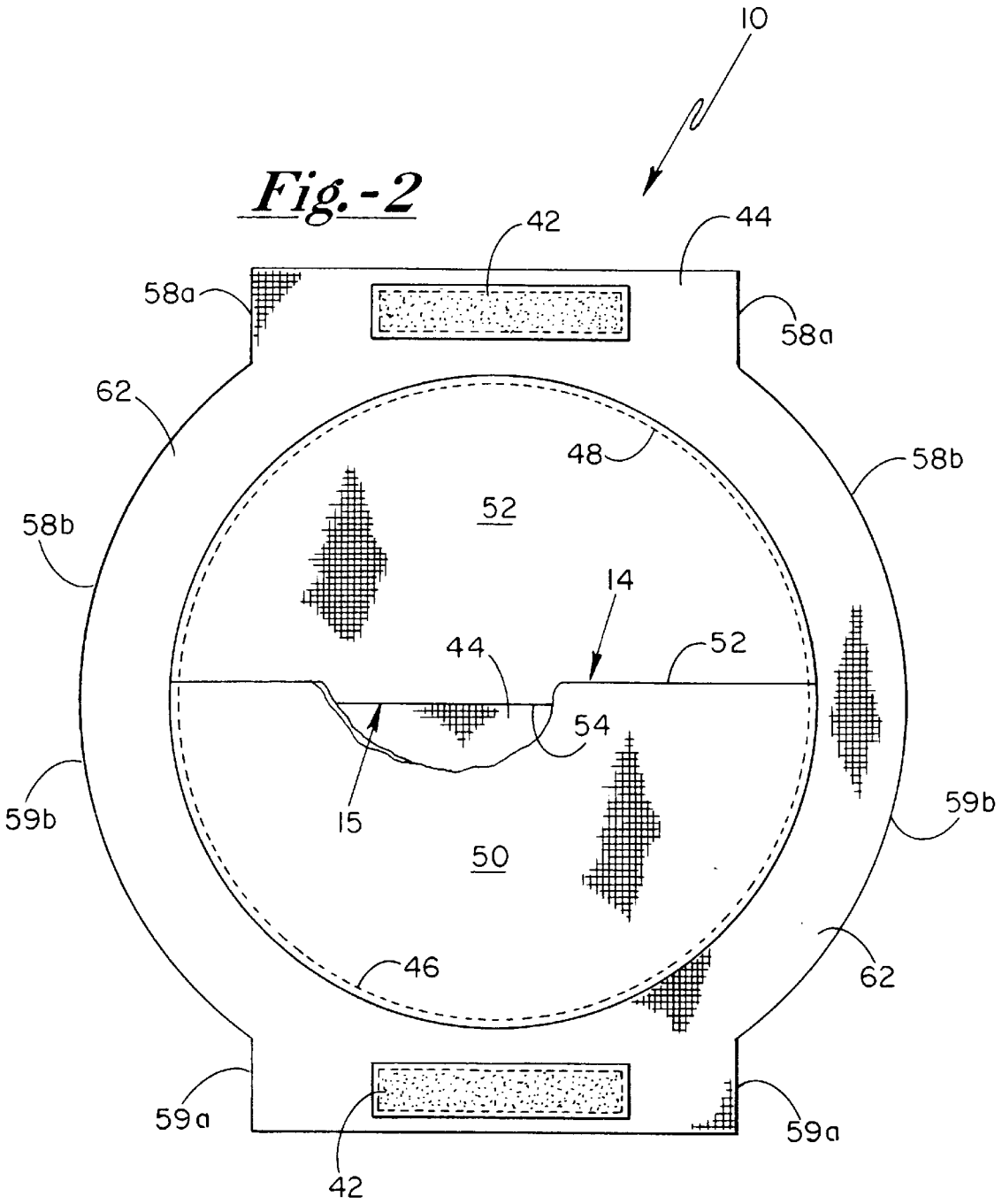
FIG. 2 shows an elevation, inside-out view of the shoulder gel cushion of FIG. 1 prior to stitching the sides of the cushion, and a portion of the drawing is broken away to show the dual overlapping pockets.

More specifically, as shown in FIG. 2, the shoulder gel cushion 10 includes a base piece 44 of plush, soft, stretchable, washable fabric such as polar fleece or nylon spandex. Further some types of terry cloth may be used. Polar fleece fabric is preferred. Base piece 44 is generally formed in the shape of a watchface.

Pockets 14 and 15 are formed by stitching, via respective stitch lines 46, 48 respective semicircular shaped pieces 50, 52 to the base piece 44. Pieces 50, 52 are preferably formed of the same material from which base piece 44 is formed. Pocket piece 50 includes an edge 52 which overlaps a corresponding edge 54 of pocket piece 52. Such provides at least a first portion of a tortuous path to minimize loss of the viscoelastic gel pack 13.

FIG. 2 further shows side peripheral linear portions 58*a* to be stitched to side peripheral linear portions 59*a* and further shows side peripheral arc like or circular portions 58*b* to be stitched to side peripheral arc like or circular portions 59*b* after the base piece 44 has been folded over relative to a fold line defined generally by the overlapping edges or edge portions 52 and 54.

FIG. 2 further shows arc like portions 62 which later form arc like channels 64 (shown in FIG. 4) for receiving arc like end portions 66 of the crutch shoulder portion 16 (shown in FIG. 1).

FIG. 2 further shows that closures 42 are engaged, such as by stitching, to the inner face of the base piece 44. One of the closures 42 include Velcro® hooks and the other of the closures 42 includes Velcro® loops.

Figure 3:
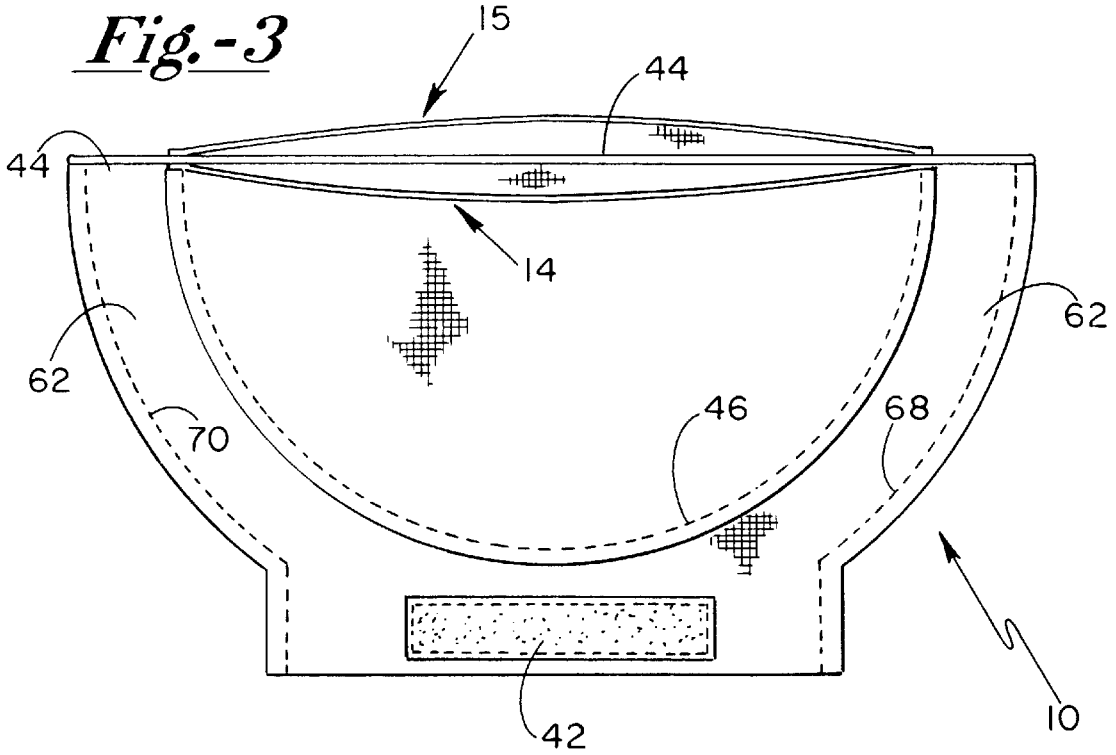
FIG. 3 shows a perspective, inside out view of the shoulder gel cushion of FIG. 2 after such sides have been stitched, and shows open pockets.
Figure 4:
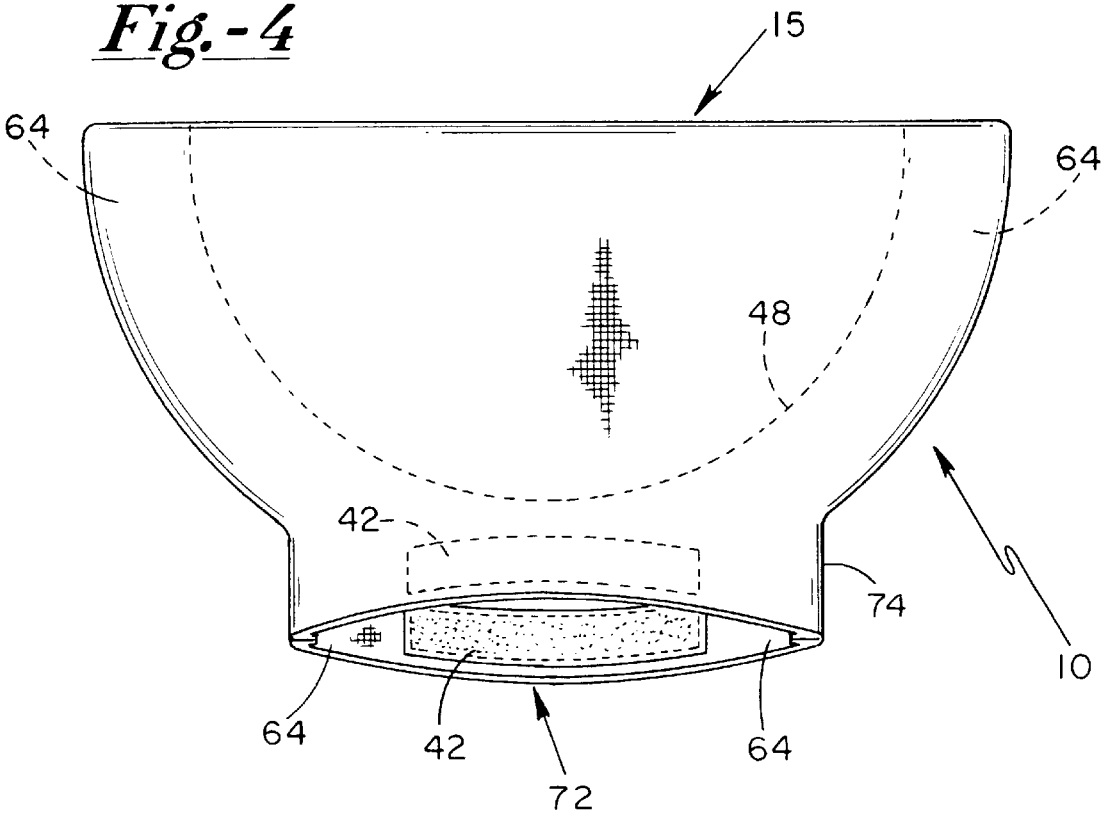
FIG. 4 shows a perspective, right-side out view of the shoulder gel cushion of FIG. 3 after such has been turned right-side out so as to close and overlap the pockets.

FIG. 3 shows a pair of stitch lines 68, 70 for stitching closed peripheral portions 58*a*, 59*a*, 58*b*, and 59*b*. Such stitching thereby forms an opening 72, which is shown in FIG. 4 and which is formed when the gel cushion 10, in its inside out form 12, is turned right-side out as shown in FIG. 1. Opening 72 has a stretched diameter greater than the diameter of disk shaped gel pack 13 such that the gel cushion 10 may be readily turned inside out when the gel pack 13 is in the pockets 14 and 15. Opening 72 has an unstretched width less than the diameter of gel pack 13 so as to provide a further portion of the tortuous path which minimizes loss of the gel pack 13 such as loss due to the gel pack 13 falling out of the gel cushion 10. In other words, opening 72 is defined by a neck or bottleneck 74 out of which gel pack 13 cannot fall unless the neck 74 is stretched or ripped. Neck 74 is defined in part by linear peripheral portions 58*a* and 59*a*.

The gel pack 13 has generally the same diameter as either of the pockets 14 and 15 such that the gel pack 13 is snugly held in the pockets 14 and 15.

Figure 5:
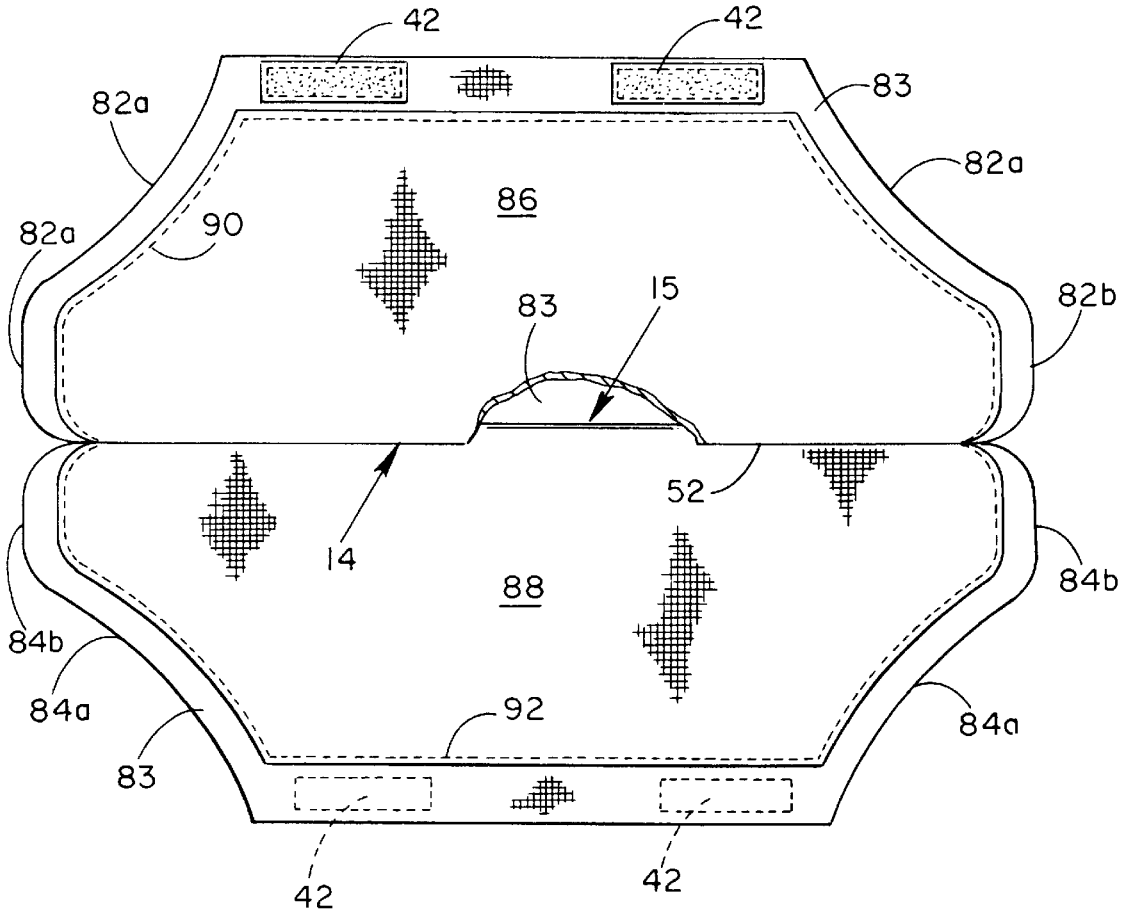
FIG. 5 shows an elevation, inside-out view of another embodiment of a shoulder gel cushion prior to stitching the sides of the cushion, and indicates through a broken away portion the overlapping pockets.
Figure 8:
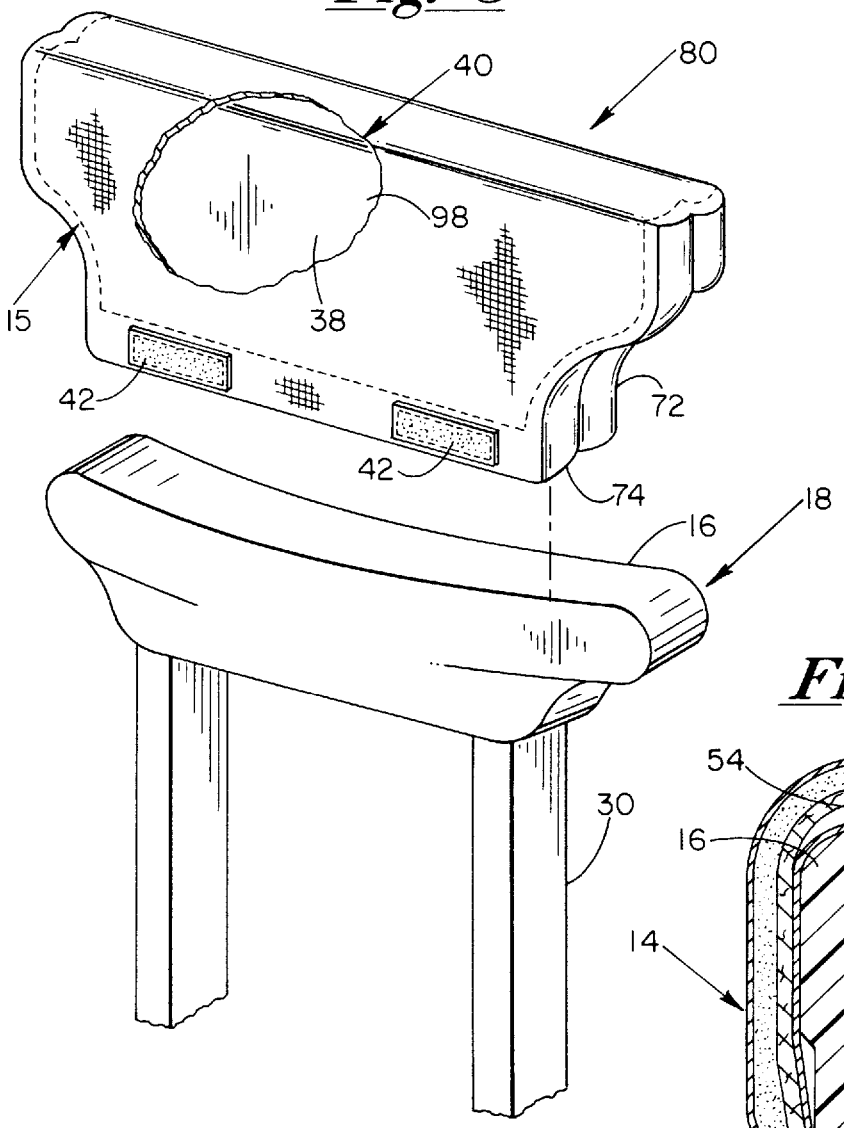
FIG. 8 shows a perspective view of the shoulder gel cushion of FIG. 5 being placed over the shoulder portion of a crutch, and a portion of the drawing is broken away to show the gel pack.

FIG. 5 shows a shoulder gel cushion 80 having some of the same features of the shoulder gel cushion 10. Shoulder gel cushion 80 includes dual opposing and overlapping pockets 14 and 15, overlapping pocket edges 52, 54, and opening 72 and neck 74. Opening 72 and neck 74 are shown in FIGS. 6 and 8.

Shoulder gel cushion 80 is different from shoulder gel cushion 10. For example, shoulder gel cushion 80 includes a base piece 83 of a different shape. Such shape is defined by peripheral linear side portions 82*b* and 84*b*, which are adjacent the fold line of the base piece 83 and which are to be stitched to each other. Such shape is farther defined by concave or arc like peripheral portion 82*a* and 84*a*, which form at least a portion of the neck 74. Each of the pocket forming pieces 86 and 88 generally reflects one half of the shape of the base piece 83, and are of a smaller size so as to form the peripheral portions or segments 82*a*, 82*b*, and 84*a*, 84*b*. Pocket forming pieces 86 and 88 are stitched to base piece 83 via stitch lines 90 and 92 respectively. Pocket forming pieces 86 and 88 are stitched adjacent to the periphery of the base piece 83 such that channels 62 (FIG. 2) are not present in gel cushion 80 (FIG. 5).

Further, shoulder gel cushion 80 (FIG. 5) includes closures 42 which are engaged, such as by stitching to each of the outer and inner faces of the base piece 83.

FIG. 6 shows the gel cushion 80 where the peripheral side portions 82*a* have been stitched to peripheral side portions 84*a*and where peripheral side portions 82*b*have been stitched to peripheral side portions 84*b* by stitch lines 92 and 94.

FIG. 6 further shows a gel pack 95 having the viscoelastic gel 40 or more specifically an inner relatively hard layer 96 of a viscoelastic gel and an outer relatively soft layer 98 of a viscoelastic gel. Both layers 96, 98 are encapsulated in the moisture resistant or moisture proof elastomeric envelope 38 such as a silicone rubber envelope. The inner relatively hard layer 96 confronts the shoulder portion 16 of the crutch 18. The inner relatively soft layer 98 confronts the underarm of the user of the crutch 18. Gel pack 95 preferably has a generally uniform thickness and is readily foldable about the fold line indicated. Such a fold line is gradual, rather than sharp, as the gel pack 95 bends about the upper face of the shoulder portion 16 of the crutch 18. If desired, the base relatively hard layer 96 may not be viscoelastic. It should be noted that "hard" or "degree of hardness" means the durometer of the gel.

FIG. 6 further indicates that the shape of the gel pack 95 is generally the shape and size of the pockets 14 and 15 combined (minus the overlapping portions of the pockets 14 and 15 as shown in FIG. 5) so as to minimize the play between gel pack 95 and the pockets 14 and 15.

FIG. 7 shows the layers 96, 98 in section and further indicates, via phantom line 100, how the soft gel layer 98 may be compressed under the pressure of an underarm with the hard layer 96 being minimally compressed.

Figure 9:
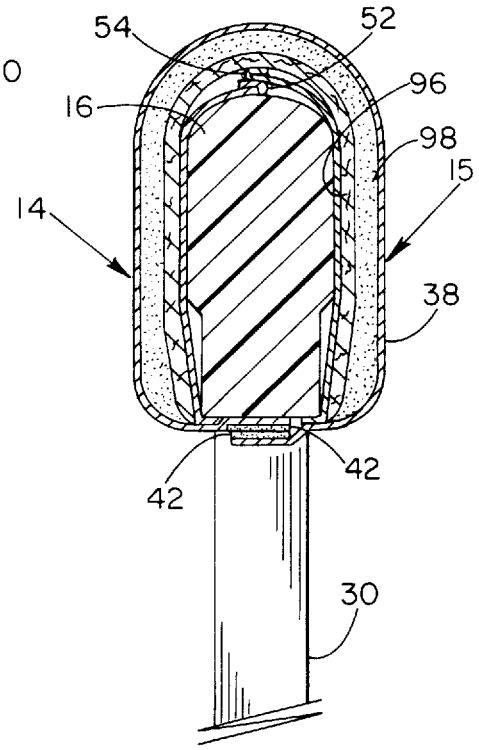
FIG. 9 shows a section view of FIG. 8 after such shoulder gel cushion has been placed on the shoulder portion of the crutch.

FIG. 8 indicates the gel cushion 80 about to placed on the shoulder crutch portion 16. Here the neck 72 is resiliently stretched to widen the opening 74. FIG. 9 shows each pair of the closures 42 connected.

It should be noted that the gel pack 13 of gel cushion 10 (FIG. 1) may cover only a portion of the crutch shoulder portion 16. With gel pack 13, the ends of the crutch shoulder portion 16 may not be cushioned with the viscoelastic gel 40 of the gel pack 13. With gel pack 95 and gel cushion 80 (FIG. 6), the entire upper surface and entire sides of the crutch shoulder portion 16 are cushioned by the gel pack 95.

Figure 10:
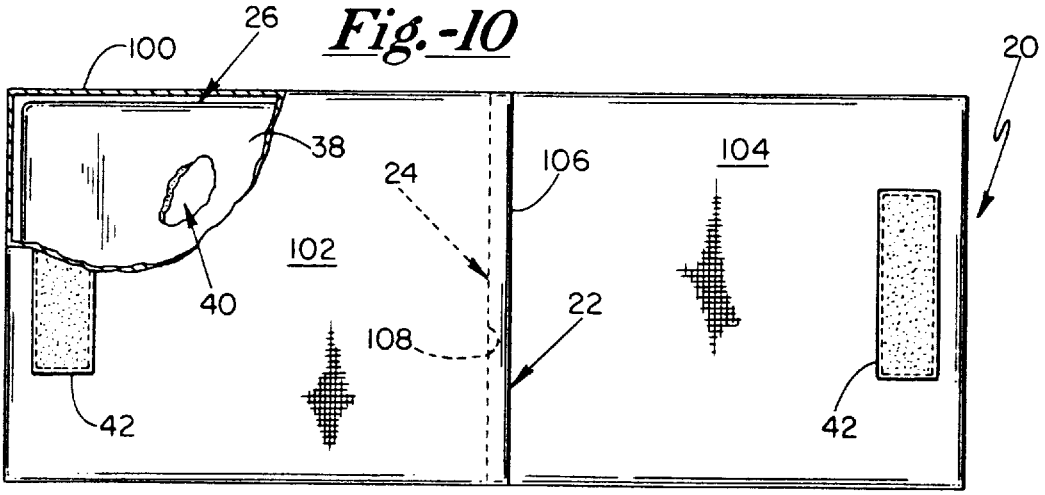
FIG. 10 shows an elevation view of the hand grip gel cushion of FIG. 1, and a portion of the drawing is broken away to show the gel pack in the dual overlapping pockets, one of which is indicated in phantom.

FIG. 10 shows a detail view of the gel cushion 20. Gel cushion 20 includes a rectangular base piece 100*a* (shown in FIG. 1) of fabric which is preferably the same fabric as base pieces 44 and 83, i.e. a polar fleece fabric. Stitched to the periphery of the base piece 100*a*are a pair of pocket forming pieces 102 and 104 to form pockets 102 and 104 respectively. Pocket forming pieces 102 and 104 have respective overlapping edges or edge portions 106 and 108 such that the pockets 22 and 24 overlap so as to form a tortuous path for unintended release of the viscoelastic gel pack 26 from the pockets or pouches 22 and 24. Gel cushion 20 has stitched thereto a pair of cooperating Velcro® closures 42 which engage each other when the gel cushion 20 is wrapped about the crutch hand grip 28.

Figure 11:
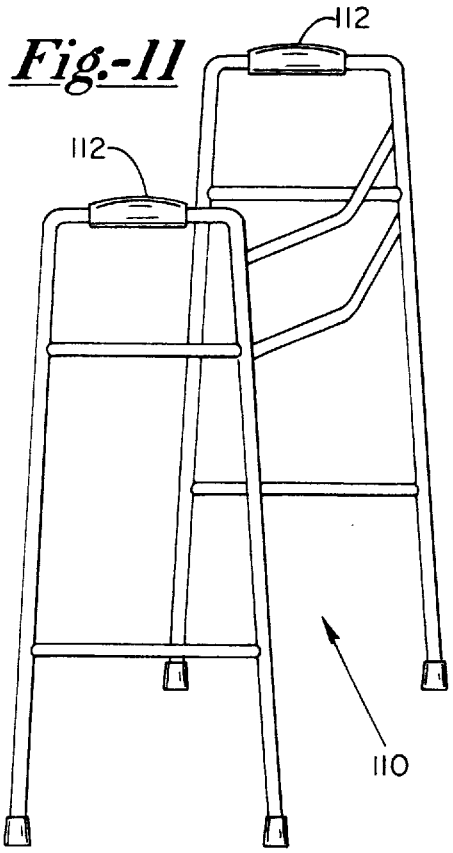
FIG. 11 shows a walker having hand grips on which the hand grip gel cushion of FIG. 10 may be used.
Figure 12:
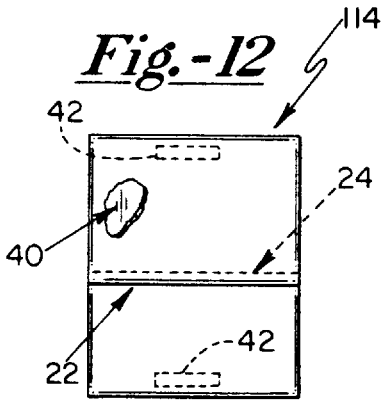
FIG. 12 shows an elevation view of a hand grip cushion similar to FIG. 10, and such is the preferred gel cushion for the walker of FIG. 11.
Figure 14:
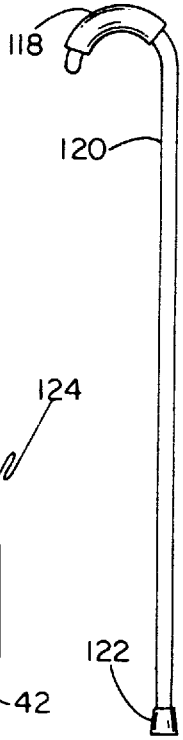
FIG. 14 shows a cane, on which the hand grip gel cushion of FIG. 12 may be used.

FIG. 11 shows a walker apparatus 110 having a pair of hand grips 112. FIG. 12 shows a gel cushion 114 having dual overlapping pockets 22 and 24 and a gel pack therein. Gel cushion 114 includes an accompanying gel pack having the viscoelastic gel layer arrangement 40. The gel pack is engaged with minimum play in the pockets 22 and 24. Gel cushion 114 is substantially wider than gel cushion 20. Gel cushion 20 or gel cushion 114 may be wrapped about hand grips 112 of the walker apparatus 110 or about a hand grip 118 of a cane 120 (shown in FIG. 14). Cane 120 includes a nonslip foot 122.

Figure 13:
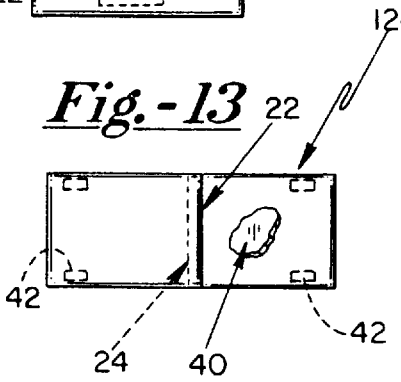
FIG. 13 shows an elevation view of the hand grip gel cushion similar to FIG. 10, and such is the preferred gel cushion for the arm rest of a wheelchair.

FIG. 13 shows a gel cushion 124 which is relatively elongate and includes four closures 42 for permitting the gel cushion 124 to be engaged about the arm rest of an elongate object such as a wheelchair arm rest. In such a case, the fold line of the gel cushion 124 runs longitudinally and the closures 42 which are stitched to the same pocket forming piece are engaged with each other under the arm rest. Gel cushion 124 has a gel pack having the viscoelastic gel layer arrangement 40 and engaged with a minimum of play in the pockets 22 and 24.

Figure 15:
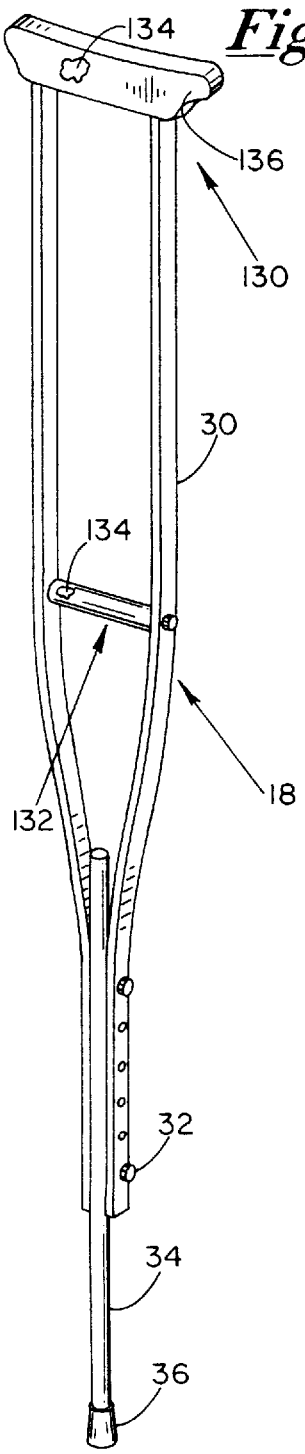
FIG. 15 shows another embodiment of the shoulder and hand viscoelastic cushions wherein such cushions are molded so as to fit directly upon a crutch and wherein each of the cushions includes an inner layer of a relatively hard viscoelastic polymer or copolymer and an outer layer of a relatively soft viscoelastic polymer or copolymer.
Figure 16:
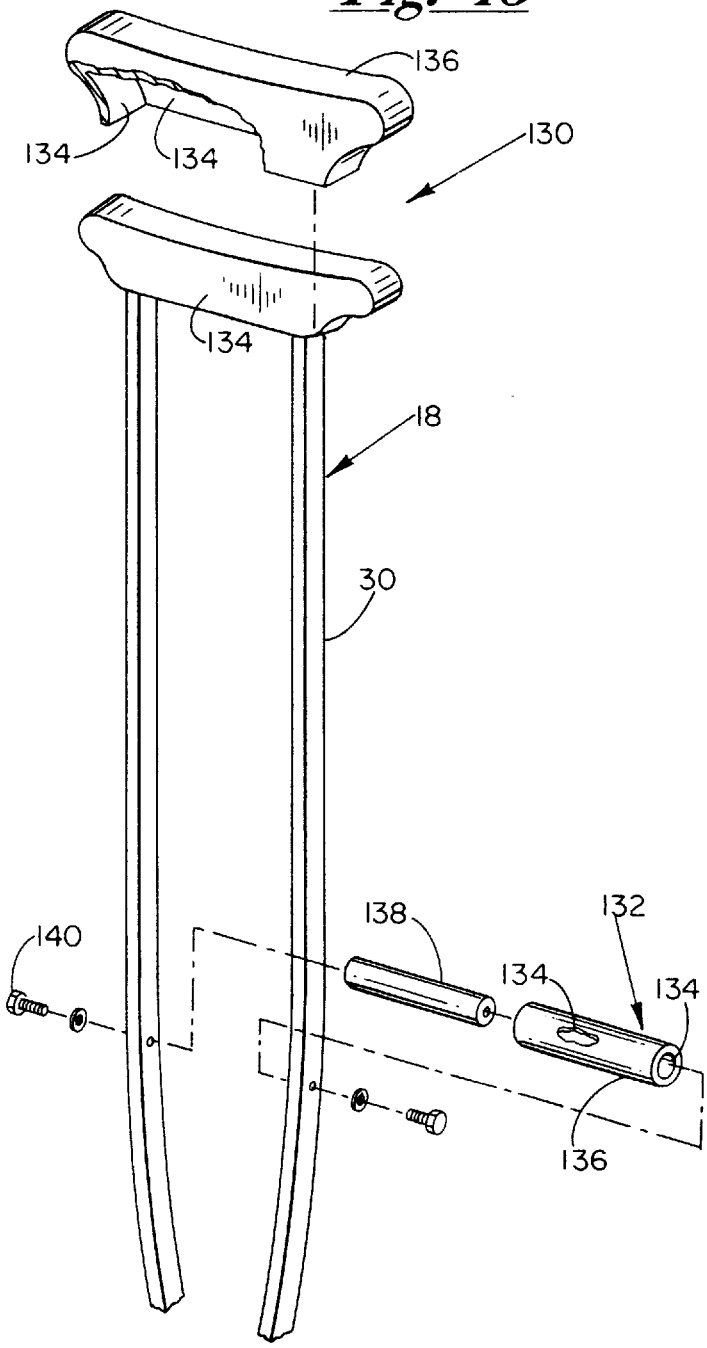
FIG. 16 shows a broken apart view of FIG. 15.

FIGS. 15 and 16 show molded viscoelastic cushions 130 and 132 which replace the crutch shoulder portion 16 and crutch hand grip 28. Each of the viscoelastic cushions 130, 132 may be formed of one viscoelastic moldable solid. More preferably, each of the viscoelastic cushions includes a relatively hard inner resilient layer 134 and a relatively soft viscoelastic outer resilient layer 136. Even more preferably, each of the layers 134 and 136 is formed of a viscoelastic moldable material. Still more preferably, each of the layers 134 and 136 may be formed of a thermoplastic elastomer which is viscoelastic. Such molded viscoelastic cushions 130 and 132 preferably include no elastomeric moisture resistant envelopes because such cushions 130 and 132 are solid or at least solid-like.

The relatively hard inner viscoelastic moldable layer 134 of viscoelastic shoulder crutch cushion 130 may be formed to reflect the shape of the upper portions of the columns 30 and engaged thereto such as with a resin or such as with a friction fit. Soft layer 136 engages the underarm. Layers 134 and 136 may be laminated together with a suitable resin. Or the outer layer 136 may simply be stretched over the inner layer 134.

Viscoelastic hand grip cushion 132 is tubular to preferably frictionally engage with or without rotation another tubular piece 138 which is engaged to the columns 30 via connector pins 140. Hard resilient inner layer 134 confronts the tubular piece 138 and soft resilient outer layer 136 engages the hand.

Figure 17:
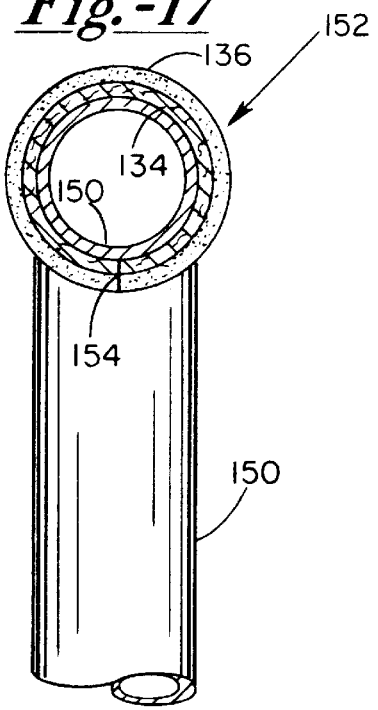
FIG. 17 shows a portion of the push rim for the wheel of a wheelchair having a molded hand grip cushion placed thereupon wherein the molded hand grip cushion includes an inner layer of relatively hard viscoelastic polymer or copolymer and an outer layer of relatively soft viscoelastic polymer or copolymer.

FIG. 17 shows a push rim 150 of a wheel of a wheelchair and further shows a molded viscoelastic cushion 152 engaged thereto. Push rim cushion 152 includes the inner relatively hard viscoelastic layer 134 and the outer relatively soft layer 136, and further includes a slit 154 formed along its entire inner diameter. Slit 154 permits the tubular molded cushion 152 to be resiliently opened and placed or snapped over the push rim 150. Preferably the tubular cushion 150 is disposed for 360 degrees about the push rim 150.

Figure 19:
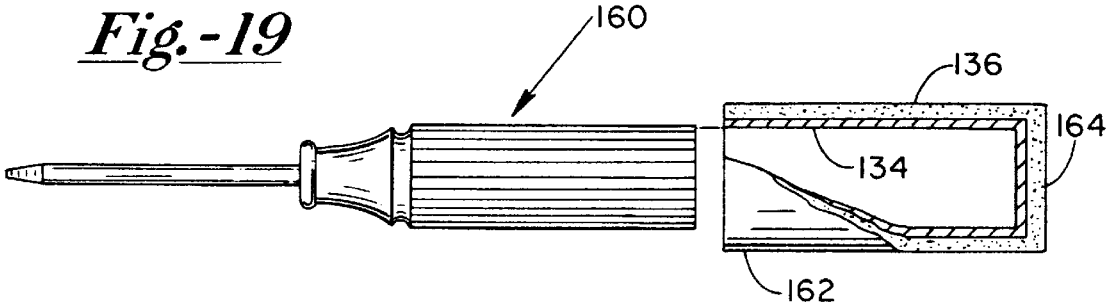
FIG. 19 shows an elevation view of a screwdriver and further shows in partial section a hand grip cushion for the handle of the screwdriver wherein the hand grip cushion shows an inner layer of relatively hard viscoelastic polymer or copolymer and an outer layer of relatively soft viscoelastic polymer or copolymer.

FIG. 19 shows a screwdriver hand tool 160 and a viscoelastic hand grip cushion 162 for the hand tool 160. Hand grip 162 may be frictionally engaged to the hand tool 160 or adhesively engaged thereto. The viscoelastic hand grip cushion 162 is tubular with a closed end 164. The viscoelastic hand grip cushion 162 includes the inner relatively hard viscoelastic layer 134 and the outer relatively soft viscoelastic layer 136.

It should be noted that the viscoelastic gel of the gel 40, where such consists of one gel or the layered gel arrangement 40, has a greater fluid "likeness" than the viscoelastic material of the layers 134 and 136 which are solids or at least are solid-like. As to such gel 40 contained in the envelope 38 and polar fleece coverings (base pieces and pocket forming pieces) of the cushions 10, 20, 80, 114, and 124, and as to such molded viscoelastic material of the layers 134 and 136, the following references are hereby incorporated by reference in their entireties: 1) SCHWARZL, F. R, "Viscoelasticity," *Encyclopedia of Polymer Science and Engineering*, Volume 17, pages 587 to 665, 1989, John Wiley & Sons, New York; and 2) KUDELA, V., "Hydrogels," *Encyclopedia of Polymer Science and Engineering,* 1989, John Wiley & Sons, New York.

If desired, it should be noted that each of the layers 134 and 136 may be formed from the gel-sponge composition described in the Chen U.S. Pat. No. 5,336,708, which layers may then be laminated together. Or, if desired, though less preferably, each of the gel cushions 130, 132, 152, and 162 may be formed from a single layer of the gel sponge composition of Chen. As to such single layered cushion embodiments, the Chen U.S. Pat. No. 5,336,708 is hereby incorporated by reference. Preferably, my molded viscoelastic gel does not include the sponge element of the Chen U.S. Pat. No. 5,336,708.

It should be noted that in place of the gel packs of the present invention, a cushion formed of foam or soft rubber, having substantially the shape of the gel pack being replaced, may be placed in the pockets of the cushion coverings. Such foam or soft rubber cushions preferably have a relatively low durometer. Examples of such include plasticized PVC, silicone rubber, closed cell polyurethane foam, closed cell PVC foam. However, viscoelastic gel packs are preferred.

It should further be noted that in place of the gel packs of the present invention, a bladder may be placed in the pockets of the cushion coverings. Such bladder preferably is a structured bladder filled with air or another gas or liquid. The bladder may be filled at the discretion of the patient with doctor consultation. When pressure is applied to the bladder, air pressure is increased to be equal along the interior of the bladder. This disperses the local forces to the entire surface of the bladder, and increases the contact area of the pad. However, viscoelastic gel packs are preferred.

It should be noted that the viscoelastic gel may be a responsive silicone gel or an interpenetrating hydrogel, encased in a suitable elastomeric envelope. Such elastomeric envelopes, such as silicone rubbers, preferably do not support biological growth and preferably are tough and strong. Such elastomeric envelopes, such as silicone rubber, are resistant to bactericides and resist breakdown by high temperatures, such as those found in locked cars parked in the sun. The envelope may be formed of polyethylene.

It should be noted that the fabric pieces, such as base pieces and the pocket forming pieces (which together form the coverings for the gel packs), are preferably absorbent to moisture such as sweat from the hands. Preferably, the immediately inner layer, the elastomeric layer 38, is resistant to such moisture.

Figure 18:
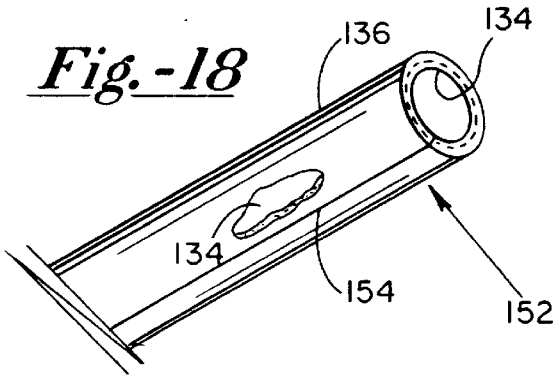
FIG. 18 shows the molded hand grip cushion of FIG. 17 in perspective.

It should be further noted that, in the layered gel arrangement having layers 96 and 98, such layers 96 and 98 are preferably sufficiently solid-like so that such layers do not intermix. It It should be noted that the tubular cushion 152 shown in FIG. 18 may serve as the walker hand grips 112, cane hand grip 118, or crutch hand grip 28. Further, the tubular cushion 152 may be placed on the wheelchair handlebar grips, emergency aluminum bars in hospitals, bathrooms, and nursing homes, the automobile steering wheel, and rehabilitation T-bars.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A cushion comprising:

a) a cover, the cover defining an opening, the cover being drawable over a structure and the cover being absorbent to moisture;

b) a pocket connected to the cover;

c) a pad, the pad being insertable through the opening and into the pocket and the pad being removable from the pocket; and d) another pocket, with one portion of the resilient pad being engaged in one of the pockets and with another portion of the resilient pad being engaged in the other pocket.

2. The cushion of claim 1, wherein the structure is a member selected from the group consisting of a crutch, a wheelchair push rim, a hand tool, a walker and a cane.

3. The cushion of claim 1, wherein the cushion comprises a hand grip.

4. The cushion of claim 1 wherein the pocket generally reflects the shape and size of the pad.

5. The cushion of claim 1 wherein the opening comprises a neck having a width and wherein the pad has a width, the width of the pad being greater than the width of the neck.

6. The cushion of claim 1 wherein the pad comprises a gel filled envelope.

7. The cushion of claim 6 wherein the gel filled envelope comprises a viscoelastic gel filled envelope.

8. The cushion of claim 1 wherein the pocket generally reflects the shape and size of the pad.

9. A cover comprising:

a structure;

an outer portion, the outer portion being selectively attachable to the structure, the outer portion being formed of a flexible material;

means for selectively attaching the outer portion to the structure;

pad means, the pad means being selectively attachable to the outer portion, the pad means having a compressibility factor; and means for selectively attaching and removing the pad means from the outer portion.

10. The device of claim 9, wherein the outer portion is formed of machine washable fabric.

11. The device of claim 9, wherein the structure is a member selected from the group consisting of a crutch, a wheelchair push rim, a hand tool, a walker and a cane.

12. The device of claim 9 wherein the pad means comprises a gel filled envelope.

13. The device of claim 12 wherein the gel filled envelope comprises a viscoelastic gel filled envelope.

14. The device of claim 12 wherein the envelop is formed of a polymer.

15. The device of claim 9 wherein the pad means is machine washable.

16. The device of claim 9 wherein the pad means is interchangeable with pad means have different compressibility factors.

17. A cover comprising:

a structure;

a machine washable outer portion, the outer portion being formed of fabric, the outer portion being selectively attachable to the structure and the outer portion being formed of a flexible material;

pad means, the pad means having a compressibility factor; and means for selectively attaching and removing the pad means from the outer portion.

18. The device of claim 17 wherein the pad means comprises a gel filled envelope.

19. The device of claim 18 wherein the gel filled envelope comprises a viscoelastic gel filled envelope.

20. The device of claim 17 wherein the attachment means comprises a pocket structure.

21. The device of claim 17 wherein the pad means comprises a plurality of pads useable singly and in combination.

* * * * *